United States Patent [19]

Oberdorf

[11] Patent Number: 4,476,665

[45] Date of Patent: Oct. 16, 1984

[54] PACKAGING MACHINE

[75] Inventor: Manfred Oberdorf, Gevelsberg, Fed. Rep. of Germany

[73] Assignee: Maschinenfabrik Alfred Schmermund GmbH & Co., Gevelsberg, Fed. Rep. of Germany

[21] Appl. No.: 326,912

[22] Filed: Dec. 2, 1981

[30] Foreign Application Priority Data

Dec. 6, 1980 [DE] Fed. Rep. of Germany ..... 3046063

[51] Int. Cl.[3] ..... B65B 19/24

[52] U.S. Cl. ..... 53/575; 53/234; 53/252; 53/236

[58] Field of Search ..... 53/575, 234, 252, 253, 53/148, 236, 563; 493/164, 247, 472

[56] References Cited

U.S. PATENT DOCUMENTS

| | | | |
|---|---|---|---|
| 665,241 | 1/1901 | Ludington | 53/253 X |
| 765,320 | 7/1904 | Page | 53/234 |
| 787,379 | 4/1905 | Hopkins | 53/234 |
| 3,585,785 | 6/1971 | Smith | 53/253 X |
| 3,968,623 | 7/1976 | Langen | 53/575 |
| 4,330,976 | 5/1982 | Blackall | 53/575 X |

*Primary Examiner*—John Sipos

[57] ABSTRACT

The packaging of plural articles in a common wrapper is accomplished with the aid of wrapping mandrels into which preformed blocks of the articles are loaded. The wrapping mandrels have movable slides which define the effective length of the mandrels and thus insure that first ends of the articles will lie in the plane of the insertion end of the mandrels, the first ends of the articles thus defining a stable base over which a wrapping may be folded. The slides are reciprocated in the mandrels to eject packages, open at one end, to a device for closing the open end.

5 Claims, 4 Drawing Figures

PACKAGING MACHINE

BACKGROUND OF THE INVENTION (1) Field of the Invention

The present invention relates to the packaging of consumer products and particularly to the formation of a wrapping around a plurality of articles in, for example, the formation of a cigarette package. More specifically, this invention is directed to a packaging machine, especially a multi-station machine, for arranging plural articles in a shaped bundle, applying a wrapping around the bundle and closing the ends of wrapping over the bundle to complete a package. Accordingly, the general objects are to provide novel and improved methods and apparatus of such character.

(2) Description of the Prior Art

While not limited thereto in its utility, the present invention is particularly well suited for use in the packaging of cigarettes. Apparatus is known in the art for forming a wrapping about a "block" of cigarettes, to define a package, and subsequently folding and glueing the ends of the wrapping to close the package. These prior art packaging machines comprise a plurality of serially arranged turntables which support cells into which the initially loose cigarettes are loaded. These turntables are axially and radially offset with respect to one another and, as the cigarettes are transferred from one turntable to the next during the packaging operation, the cells on adjacent turntables are momentarily axially aligned so that the contents of one cell may be transferred into another. Typically, the loose cigarettes are arranged into "blocks" on a first turntable and these "blocks" are subsequently transferred into hollow mandrels on a wrapping turntable. A wrapping is applied around the blocks on the wrapping turntable, a first package end formed by folding and gluing the wrapping and the partially completed packages, which are still open at one end, are subsequently transferred to a further turntable which forms part of an end closing device.

The hollow mandrels on the wrapping turntable have a length which is greater than the length of the cigarettes being packaged. Accordingly, during the transfer of the partially formed package to the turntable of the end closing apparatus, the cigarettes may impact against the first forward end of the package whereby either the cigarettes may be damaged or the said first end may open since the glue has not had time to set.

There has been a long standing desire in the art to eliminate the impingement of the cigarettes against the first formed end of the newly formed package. Thus, published German patent application Ser. No. 28 51 473 describes a device wherein movement is imparted to the block of cigarettes such that it performs a catch-up motion relative to the package. This motion is controlled so that the bottom of the block reaches the bottom of the package as the package comes to rest. Such catch-up movements are relatively complicated to implement and control and, even if successfully achieved, serve only to reduce the magnitude of the impact of the cigarettes against the end of the package. Support for the end of the package is not provided and thus it may still open before the glue has set.

SUMMARY OF THE INVENTION

The present invention overcomes the above-briefly discussed deficiencies and disadvantages of the prior art by providing a novel and improved technique for packaging articles, particularly plural relatively fragile articles, and apparatus for use in the practice of such process.

Apparatus in accordance with the present invention includes a wrapping station, which is provided with hollow mandrels mounted on a turntable, for partly packaging the articles. This wrapping turntable is moved in rotary stepwise fashion. The apparatus also includes means, in the form of axially movable sliders, for inserting the articles to be packaged into the hollow mandrels. The apparatus further includes devices for delivering wrapping paper to the wrapping turntable, for folding the paper about the hollow mandrels to form the sides and first end of a package and, located downstream in the direction of travel of the articles during the packaging procedure, a second end closing device which includes a further turntable with cells for receiving the partly packaged articles. Each hollow mandrel of the wrapping turntable includes an axially movable floor which, when activated, will transfer the partially completed packages to the second end closing device. The length of the article receiving region of the hollow mandrels is defined by the location of these movable floors in their rest position.

To further describe the preferred embodiment of the present invention, a wrapping machine includes a wrapping turntable, rotatable in stepwise fashion, which supports a plurality of hollow mandrels. These mandrels are open at a first end and receive previously formed blocks or bundles of the articles, cigarettes for example, being packaged. As the wrapping turntable rotates, the cigarettes or other articles are partially wrapped and, when the turntable reaches a discharge position, a member which is axially movable with respect to the mandrel located at the discharge position causes the package, which is still open at one end, to be transferred to an end closing device. The movable members in each mandrel of the wrapping turntable form a closed end of the mandrel and thereby define an interior length which is commensurate with the length of the articles being wrapped. These mandrel end defining members are maintained in position until the wrapping turntable reaches the discharge position whereupon they are caused to move axially to discharge the contents of the mandrel into the end closing device.

BRIEF DESCRIPTION OF THE DRAWING

The present invention may be better understood and its numerous objects and advantages will become apparent to those skilled in the art by reference to the accompanying drawing wherein like reference numerals refer to like elements in the several FIGURES and in which.

DESCRIPTION OF THE PREFERRED EMBODIMENT

Figure 2:
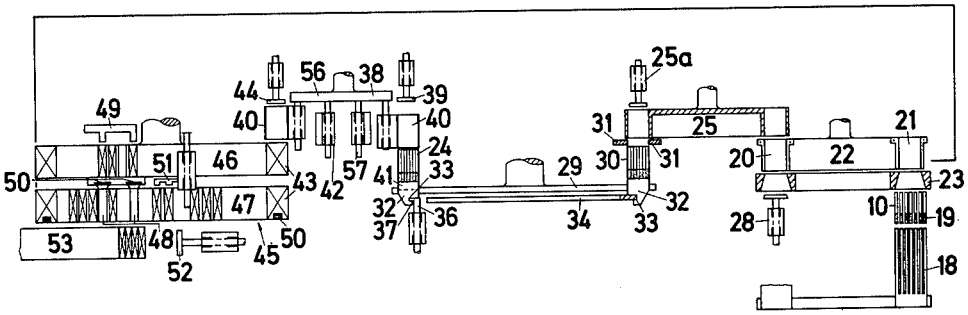
FIG. 2 is a schematic plan view of the machine of FIG. 1.

With reference now to the drawing, and considering all the FIGURES simultaneously, for purposes of explanation a cigarette packaging machine has been depicted. The cigarettes 10 to be packaged in this machine are received on a feed belt 11. The cigarettes are delivered to the packaging machine in a direction transverse to their axial length and are conveyed into a pair of hoppers 12 and 13. An auxiliary feed belt 12 assists in the distribution of the cigarettes into the two hoppers. The hoppers 12 and 13 feed directly into chutes 15 and 16 which are provided with plural intermediate walls 17 for the purpose of forming side-by-side rows of superimposed cigarettes. Groups or bundles of cigarettes 10 are discharged from the chutes 15, 16 with the aid of simultaneously operated rams 18 which may best be seen from FIG. 2. The rams 18 preferably engage the filter ends 19 of the cigarettes in the case where filter tip cigarettes are being packaged.

The cigarettes discharged from chutes 15 and 16 are inserted into tubular cells 20, 21 of a block turntable 22. The block turntable 22 may, for example, have six divisions with each division comprising a pair of cells. In passing from the chutes into the cells, the cigarettes are forced through a restricted opening 23 which urges the cigarettes closer together thus compensating for the removal of the partitions 17 of the chutes. Accordingly, "blocks" 24 comprised of plural cigarettes are formed in the cells 20, 21 of the block turntable 22. The block turntable is driven, by means of a step drive (not shown), through two cell divisions with each step of motion. Accordingly, after a second complete rotation, all of the cells of turntable 22 will be filled with cigarette blocks 24. The fact that some cells are empty after the first revolution of turntable 22, on start-up of the machine, may be taken into account in the operation of the wrapping apparatus located downstream of the block turntable in the direction of product movement.

Figure 1:
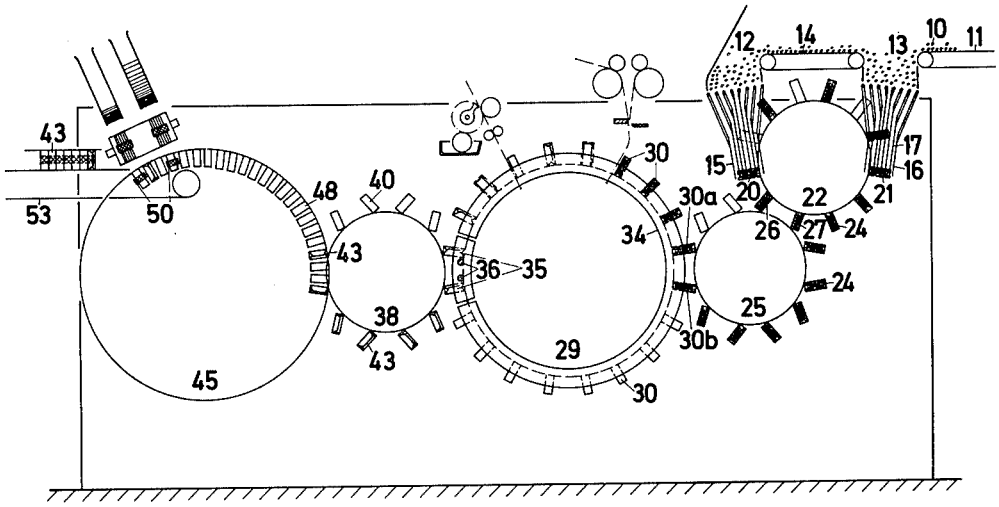
FIG. 1 is a schematic side-elevation view of a packaging machine which includes wrapping apparatus in accordance with the present invention.

In the embodiment depicted, there is an even number of cells on block turntable 22 between the cells 20 and 21 which, as the apparatus is depicted in FIG. 1, are simultaneously being filled.

The cigarette blocks 24 are transferred from the block turntable 22 to a pressing turntable 25. The pressing turntable 25 will comprise cells 26, 27 in which the cigarette blocks 24 are "trued-up" by pressing. The pressing turntable 25 may also include sensing means which insures that each block is complete, such sensing apparatus having been omitted from the drawing in the interest of facilitating understanding of the present invention. The cigarette blocks 24 are transferred from the block turntable 22 into the cells of pressing turntable 25 by means of a pair of sliders or rams 28, one of which may be seen in FIG. 2. During the transfer the cigarettes are moved in the axial direction from two neighboring full cells of the block turntable 22 into two neighboring cells of the pressing turntable 25 which are aligned therewith. As in the case of the block turntable, the pressing turntable is operated in stepwise fashion through two cell divisions.

Figure 3:
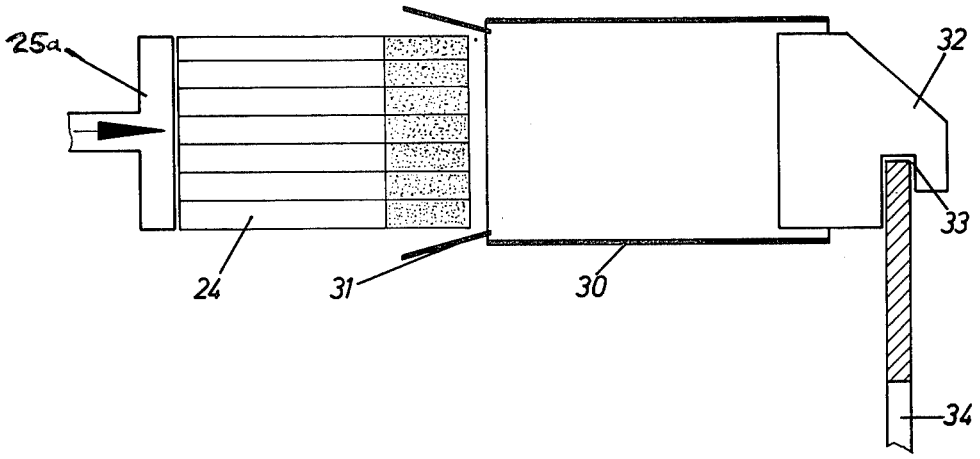
FIG. 3 is an enlarged schematic view of a portion of wrapping apparatus in accordance with the present invention, the apparatus of FIG. 3 comprising part of the packaging machine of FIGS. 1 and 2.
Figure 4:
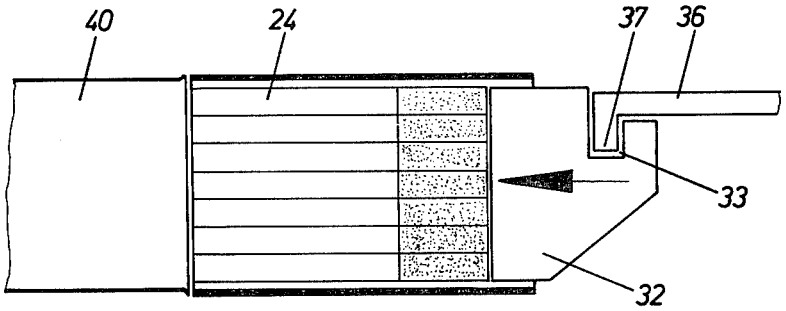
FIG. 4 is a view similar to FIG. 3 depicting the unloading sequence of the wrapping apparatus.

A wrapping turntable 29 is positioned so as to receive the pressed cigarette blocks from turntable 25. Wrapping turntable 29 comprises a plurality of hollow mandrels 30 which, in the example being described, are 20 in number. The mandrels 30, which may clearly be seen by reference to FIGS. 3 and 4, are open in the axial direction. Mandrels 30 are disposed equidistantly about the circumference of the wrapping turntable 29 and are located on radii of the turntable as shown in FIG. 1.

The cigarette blocks 24 are transferred simultaneously from two neighboring cells of the pressing turntable 25 into two neighboring hollow mandrels **30*a*, 30*b* of wrapping turntable 29 by means of a pair of sliders 25*a*. In order to insure that the cells of the pressing turntable are axially aligned with the hollow mandrels 30, whereby the transfer of the blocks may occur, the cells of pressing turntable 25 are arranged in pairs with the cells of each pair being inclined toward one another. This inclination corresponds to the relative inclination of adjacent mandrels 30*a*, 30*b*. The cells 20, 21 of the block turntable 22 are also arranged so that the inclination of adjacent pairs of cells is the same as the inclination of the pairs of cells 26, 27** of the pressing turntable for the same reason.

The wrapping turntable 29 is rotated in stepwise fashion in synchronism with the rotation of the other turntables of the packaging machine and the double transfer process takes place at every second sequential movement. During transfer the cigarette blocks are guided into the hollow mandrels by means of guide apertures 31.

The packages for the cigarette blocks are formed on the wrapping turntable 29 in the manner well known in the art. This may, for example, be accomplished in accordance with the teachings of German Pat. No. 920,057. During this process, inner and outer paper webs are drawn from storage reels, as indicated schematically on FIG. 1, and cut to predetermined lengths. Then, after appropriate gluing, the wrapping material is fed to turntable 29, a package formed around each cigarette block and the bottom end of each package folded closed.

The end of each of the hollow mandrels 30 of the wrapping turntable 29 which is located opposite to the insertion opening includes a slide member 32. These slide members 32 are provided with a guide notch 33. The guide notches 33 receive a fixed, circular ring 34. The circular ring 34 is interrupted at two adjacent mandrel positions 35 which are aligned with reciprocating fingers 36, the fingers 36 engaging the notches 33 by means of projections 37 when the mandrels are rotated with turntable 29 to the discharge positions 35. When the fingers 36 engage the slide members 32, and the fingers are caused to reciprocate, the slide members 32 will act as rams to transfer a pair of neighboring wrapped cigarette blocks 34 onto a turntable 38 of a top closing device. In the embodiment disclosed, the top closing turntable 38 comprises six divisions, each division consisting of two cells.

The dimensions of the sliding elements 32 are selected such that, upon transfer of a cigarette block from the pressing turntable 25 into a mandrel 30 on the wrapping turntable 29, first ends of the cigarettes will lie in a plane which is defined by the open insertion end of the mandrels. The second ends of the cigarettes comprising the block will thus be positioned against a flat surface, i.e., a movable floor, of the slide members 32. Accordingly, after a package has been partially completed by folding around the mandrel on the wrapping turntable, the cigarette block 24 will offer a support for the folding of the first end or bottom of the package, this first package end being at the insertion end of the hollow mandrel. Accordingly, since there will be no gap between the first formed end of the package and the cigarette block, the impact of cigarettes against the bottom of the package cannot occur as the partly packaged cigarette blocks are moved to the next station in the packaging machine. The technique of the present invention, as described, also renders it possible to employ a follower 39, see FIG. 2, during the transfer of a partly completed package from the wrapping turntable 29 into cells 40 of an end or top closing turntable 38. The follower device 39 will firmly hold the bottom fold (first formed end) of the package closed during the transfer operation and will thus prevent the package from coming open before the glue has set. This operation is achieved without the need for any catching-up movement and thus is more reliable and less difficult to implement when compared to the prior art.

The end closing apparatus, as noted above, includes a turntable 38 which supports cells 40. These cells 40 are disposed in inclined paths and thus have the same relationship to the hollow mandrels 30 as do the cells of the pressing turntable 25. The end closing turntable 38 is also driven in the same manner and in synchronism with the remainder of the apparatus. The cells 40 are mounted on the turntable 38 in an axially slidable manner on guides 57 by means of slides 56, the slides and guides being shown schematically in FIG. 2 and being controlled by means of a cam, not shown. When a pair of neighboring cells 40, into which partially packaged cigarette blocks 24 are to be transferred, are in the transfer position 35, the two receiving cells 40 are moved out of range of the projecting length 41 of the wrapping material while the follower device 39 contacts and thus holds the bottom fold of the package firmly. On stepwise operation through two cell divisions at every second sequential movement of the apparatus, the two cells 40 are moved back to the position indicated at 42 and the ends of the packages are closed in the manner known in the art, the apparatus for folding the wrapping material to close the end of the package having been omitted from the drawing since it does not comprise part of the invention.

The finished packages, indicated at 43 in FIG. 1, are inserted in pairs onto a drying turntable 45 by means of a double slider or ram 44. The drying turntable, as may be seen from FIG. 2, consists of a pair of rotors 46, 47 which are axially disposed one behind the other. The rotors 46 and 47 each comprise a plurality of cells which is a multiple of the number of cells supported on turntable 38. In the apparatus disclosed, the rotors 46 and 47 comprise sixty aligned cells 48 and every third cell of rotor 46 is filled with a package 43. The drying turntable 45 is always operated stepwise through cell divisions so that all of the cells 48 become filled one after the other.

After the packages 43 have been conveyed by rotor 46 about an arc of almost 360°, the packages are transferred into the cells of rotor 47 by means of a double slider or ram 49. Before this transfer operation is performed, a seal is positioned in front of the two packages to be transferred and retained in position by means of suction. Thus, when the packages 43 are transferred between the rotors 46 and 47 by means of the double slider 49, the seals 50 become glued to the packages. After the packages provided with the seals, which are indicated at 50, pass through one complete revolution of rotor 47, they are discharged in pairs through the action of a double slider 51 and transferred to a conveyor belt 53 by means of a ram 52.

The double sliders 49 and 51 are driven by the same drive which imparts motion to the double ejection device 44. The use of a dual rotor drying turntable 45 insures a long drying time and thus makes the heating of the cells 48 unnecessary. Additionally, the long drying time and the use of a dual rotor turntable facilitates the placing of the seals 50 on the packages.

The transfer between the rotors 46 and 46 and the ejection of the packages from rotor 47 is carried out in an out-of-phase manner.

To summarize the operation of the present invention, the cigarettes being packaged fill the total receiving region, defined within the mandrels 30, because of the fact that they are inserted into the hollow mandrels as far as the slide 32 which functions as a stop. Accordingly, first ends of the cigarettes will be located in a plane which is flush with the plane of the insertion opening of the mandrel so that, during the folding operation, the cigarette block acts as a support for the folding of the bottom of the package. Subsequently, during the discharge of the partly packaged cigarette block from the wrapping turntable into the top closing device, there will be no movement of the cigarettes toward the bottom of the package and the fold defining the bottom of the package will be maintained in the closed state by a follower. This follower moves in synchronism with the slider in the discharge direction and, at the beginning of the cycle wherein the package is transferred from the wrapping turntable into the cells on the turntable of the top closing device, the follower is already in contact with the bottom of the package.

While a preferred embodiment has been shown and described, various modifications and substitutions may be made thereto without departing from the spirit and scope of the invention. Accordingly, it is to be understood that the present invention has been described by way of illustration and not limitation.

What is claimed is:

1. In apparatus for packaging cigarettes, the apparatus including means for forming individual cigarettes into blocks, the improvement comprising:

wrapping turntable means, said wrapping turntable means including a turntable having an axis and a plurality of tubular mandrels supported on the turntable and extending generally parallel to said axis of the turntable, each of said mandrels having an insertion end which defines a plane and a cross-sectional size and shape commensurate with a cigarette block to be packaged;

means for imparting rotary stepwise motion to said wrapping turntable means, said motion imparting means causing the rotary position of said turntable means to be incremented in steps equal to the spacing between said mandrels;

a plurality of slide members, one of said slide members extending into each of said wrapping turntable means mandrels from the end opposite to the insertion end thereof, said slide members having a rest position which defines an interior mandrel length substantially equal to the length of the cigarettes being packaged, said slide members being individually axially movable with respect to said mandrels for unloading said mandrels;

means for feeding packaging material to said wrapping turntable means;

means for feeding cigarette blocks into said mandrels through said insertion ends thereof and into contact with said slide members whereby the cigarettes in a mandrel extend from the slide member to the mandrel insertion end and first ends of the cigarettes will lie generally in said plane of said mandrel insertion end;

means for folding packaging material over the insertion ends of and around individual of said mandrels whereby the folded packaging material will be juxtapositioned to said cigarette first ends;

guide means for determining said rest position of said slide members in and adjacent the ends of said mandrels disposed opposite to said insertion ends during the feeding of cigarette blocks into said mandrels and for maintaining this positioning during the motion of said turntable means between a loading position and an unloading position, said guide means comprising a fixed circular ring which prevents axial movement of said slide members with respect to their respective mandrels, said ring being interrupted at the unloading position of said turntable means;

means for engaging said slide members at the unloading position of said turntable means as determined by the interruption in said guide means ring, said engaging means comprising a reciprocal actuator for imparting axial motion to said slide members to eject the cigarette blocks and the packaging material which has been folded about the mandrels from said turntable means as units, the cigarettes being ejected through said mandrel insertion ends; and top closing means for closing the tops of the units, said units being transferred to said top closing means by said slide members at the unloading position of said turntable.

2. The apparatus of claim 1 wherein each of said slide members is provided with a notch which is engaged by said circular ring, said slide member notches being engaged by said engaging means actuator at the unloading position of said turntable means.

3. The apparatus of claim 1 further comprising:

follower means, said follower means being positioned in registration with the unloading position of said turntable means, said follower means being operated in synchronism with said engaging means actuator, said follower means contacting the end of a unit which is disposed opposite to the end contacted by a slide member.

4. The apparatus of claim 2 further comprising:

follower means, said follower means being positioned in registration with the unloading position of said turntable means, said follower means being operated in synchronism with said engaging means actuator, said follower means contacting the end of a unit which is disposed opposite to the end contacted by a slide member.

5. The apparatus of claim 4 wherein said top closing means includes a further rotary turntable means, said further turntable means carrying cells, the cells of said further turntable means receiving units unloaded from said wrapping turntable means.

* * * * *